US010046943B2

(12) United States Patent
Sorrentino

(10) Patent No.: US 10,046,943 B2
(45) Date of Patent: Aug. 14, 2018

(54) METHOD AND APPARATUS FOR WINDING A CONTINUOUS FLEXIBLE ELONGATED ELEMENT

(71) Applicant: FB BALZANELLI S.R.L., Milan (IT)

(72) Inventor: Marco Sorrentino, Mondolfo (IT)

(73) Assignee: FB BALZANELLI S.R.L., Milan (IT)

( * ) Notice: Subject to any disclaimer, the term of this patent is extended or adjusted under 35 U.S.C. 154(b) by 0 days.

(21) Appl. No.: 15/322,983

(22) PCT Filed: Apr. 30, 2015

(86) PCT No.: PCT/IB2015/053146
§ 371 (c)(1),
(2) Date: Dec. 29, 2016

(87) PCT Pub. No.: WO2016/001773
PCT Pub. Date: Jan. 7, 2016

(65) Prior Publication Data
US 2017/0129728 A1 May 11, 2017

(30) Foreign Application Priority Data
Jun. 30, 2014 (IT) ..... MI2014A1188

(51) Int. Cl.
*B65H 65/00* (2006.01)
*B65H 19/28* (2006.01)

(52) U.S. Cl.
CPC ..... *B65H 65/00* (2013.01); *B65H 19/28* (2013.01); *B65H 2301/41422* (2013.01);
(Continued)

(58) Field of Classification Search
CPC ..... B65H 65/00; B65H 75/28; B65H 19/28; B65H 2301/5151; B65H 2301/41428;
(Continued)

(56) References Cited

U.S. PATENT DOCUMENTS 4,610,404 A * 9/1986 Maccaferri ..... B65H 65/00 242/473.7
5,105,944 A 4/1992 Ingalls et al.
(Continued)

FOREIGN PATENT DOCUMENTS

JP H0381016 A 4/1991
JP 2002265102 A 9/2002
WO WO-02074675 A1 * 9/2002 ..... B65H 65/00

OTHER PUBLICATIONS

International Search Report and Written Opinion dated Jul. 28, 2015 from counterpart PCT App No. PCT/IB2015/053146.

*Primary Examiner* — William E Dondero
(74) *Attorney, Agent, or Firm* — Shuttleworth & Ingersoll, PLC; Timothy J. Klima

(57) ABSTRACT

An apparatus for winding a continuous flexible elongated element, preferably made of plastic material, around a spool including a drive means configured for rotating a spool around a winding axis. The spool is provided with a winding core extending along the winding axis. Delivery means are configured for delivering an elongated retaining element, preferably a retaining film, at the spool. Winding means are configured for at least partially winding the elongated retaining element around the winding core so as to retain a free end of the continuous flexible elongated element on the winding core.

16 Claims, 9 Drawing Sheets

(52) U.S. Cl.
CPC ..... *B65H 2301/41428* (2013.01); *B65H 2301/5151* (2013.01); *B65H 2701/33* (2013.01)

(58) Field of Classification Search
CPC . B65H 2301/41422; B65H 2701/33–2701/333
See application file for complete search history.

(56) References Cited

U.S. PATENT DOCUMENTS

| | | | |
|---|---|---|---|
| 2010/0320302 | A1 | 12/2010 | Pappas et al. |
| 2013/0320124 | A1 | 12/2013 | Rochon et al. |

* cited by examiner

METHOD AND APPARATUS FOR WINDING A CONTINUOUS FLEXIBLE ELONGATED ELEMENT

This application is the National Phase of International Application PCT/IB2015/053146 filed Apr. 30, 2015 which designated the U.S.

This application claims priority to Italian Patent Application No. MI2014A001188 filed Jun. 30, 2014, which application is incorporated by reference herein.

The present invention relates to a method and an apparatus for winding a continuous flexible elongated element.

In particular, the present invention relates to the field of the winding of flexible hoses or rubber profiles to form coils of different sizes, preferably in output from the production line.

In this field, the use of spools is known that are formed by a winding core delimited by respective side shoulders of the tube or the profile wound. The side shoulders have larger diameter than the winding core. Depending on the field of use, the countries in which the tube or profile is marketed and the materials, spools having different types and sizes can be used.

In all cases, the winding of the tube or profile on the spool starts with its locking/engagement on the spool, which is then set in rotation. Usually, a free end of the tube/profile, or a terminal edge thereof is blocked, which is arranged at that free end.

The locking of the tube/profile to the spool at the beginning of the winding has always been performed manually by the operator at the beginning of each new coil. Alternatively, however, automatic procedures have been implemented that have some flexibility limits.

Among the automatic locking systems, locking systems are known that are suitable to be associated to one of the side shoulders of the spool. In particular, clamps are known that are adapted to be arranged at the outer circumference of the respective side shoulder. In this case, when effecting the locking/engagement of the tube/profile to the clamp, its free end is located at the outer circumference of the clamp, and during the rotation of the spool a tube/profile section is generated that connects the clamp to the winding core. Such a tube section/profile creates an obstacle to the proper alignment, in particular of the first coils and, at the end of the winding, it projects outwardly from the coil completely wound.

It follows that the use of clamps applied at the outer circumference of the respective containing shoulders allows the use of any type of spool but generates drawbacks during the winding.

To resolve this drawback, coils specially prepared have been used so as to accommodate a locking device, preferably of a pneumatic type, suitable to hold the free end of the tube/profile pressed against the winding core.

Unfortunately, even such application has disadvantages in that spools specially modified should be used, for example by realizing an opening in at least one of the shoulders enabling the insertion of the locking device.

In this context, the technical task underlying the present invention is to propose a method and an apparatus for winding a continuous flexible elongated element that overcomes the drawbacks of the prior art mentioned above.

In particular, an object of the present invention is to provide a method and an apparatus for winding a continuous flexible elongated element able to adapt to any type of spool.

A further object of the present invention is to propose a method and an apparatus for winding a continuous flexible elongated element in order to achieve an optimal winding.

The technical task mentioned and the objects stated are substantially achieved by a method and an apparatus for winding a continuous flexible elongated element, comprising the technical characteristics set out in one or more of the appended claims. The dependent claims correspond to different embodiments of the invention.

In particular, according to a first aspect, the present invention relates to a method for winding a continuous flexible elongated element, preferably made of plastic, around a spool. This method comprises the steps of preparing a spool provided with a winding core, preparing an elongated retaining element, preferably a retaining film, at least partial winding of the elongated retaining element around the winding core, winding the continuous flexible elongated element around the winding core in rotation around a winding axis, starting from a free end of the continuous flexible elongated element. The step of at least partial winding of the elongated retaining element around the winding core is effected so as to retain the free end of the continuous flexible elongated element on the winding core.

In this way, it is possible to obtain an engagement of the end of the continuous flexible elongated element in a completely automatic way, to any type of spool having any size, and without the need for making openings on the spool itself.

Preferably, the step of at least partial winding of the elongated retaining element around the winding core comprises a first winding step wherein the elongated retaining element is at least partially wound onto the winding core before the step of winding the continuous flexible elongated element, and a second winding step wherein the elongated retaining element is at least partially wound onto the winding core and onto the continuous flexible elongated element starting from its free end.

In this manner, the automatic locking of both the elongated retaining element and the continuous flexible elongated element is obtained.

Preferably, the first step of at least partial winding of the elongated retaining element is effected so as to generate at least one turn of the elongated retaining element around said winding core. Preferably, such a coil is obtained by means of a relative motion of roto-translatory type between the elongated retaining element and the winding core.

In this way, the amount of the material used by the elongated retaining element is optimized.

Preferably, a cutting step is provided for cutting the elongated retaining element, when the continuous flexible elongated element is held on the winding core by the elongated retaining element.

Preferably, the cutting step is realized at the end of the second winding step, when the continuous flexible elongated element is held on the winding core by the elongated retaining element.

In this way, the elongated retaining element is only used in the initial step of the method.

Preferably, the step of at least partial winding of the elongated retaining element includes rotating the spool around the winding axis.

In this way, the implementation of the method and the relevant apparatus is simplified.

Preferably, step is provided for locking a flap of the elongated retaining element with respect to said spool, to set it in rotation integrally with the spool and cause the at least partial winding around the winding core. The locking step is preferably executed at a shoulder of the spool or externally to the overall radial dimension of the spool.

In this way, the locking does not interfere with the winding of the continuous flexible elongated element.

A step is provided for unlocking said flap at the end of the first step of at least partial winding of said elongated retaining element.

In this way, the use of the elongated retaining element is optimized by using it only in the initial step of the method.

Preferably, the spool is rotated around the winding axis both in the first step of winding and in the second step of winding of the elongated retaining element. Alternatively, the spool is rotated around the winding axis only in the second step of winding of the elongated retaining element.

Preferably, before the continuous flexible elongated element is retained on the winding core by the elongated retaining element, step is provided for thrusting the continuous flexible elongated element towards the winding core.

In this way, a complete automation of the method is obtained.

Preferably, the step of winding the continuous flexible elongated element around the winding core in rotation comprises an initial winding step wherein said continuous flexible elongated element is predominantly thrust towards the winding core and a subsequent winding step wherein the continuous flexible elongated element is predominantly dragged by the spool being retained on the winding core by the elongated retaining element.

In this way, the continuous flexible elongated element is controlled at all steps of the winding.

Preferably, the step of preparing the elongated retaining element comprises a step of unwinding of the elongated retaining element from a coil arranged with axis parallel to the winding axis of the spool.

Preferably, the step of preparing the elongated retaining element is effected by dropping from above a flap of the elongated retaining element towards the winding core.

In this way, the apparatus is simplified and it is possible to obtain a complete automation of the method.

In accordance with a possible aspect, the present invention also relates to an apparatus for winding a continuous flexible elongated element, preferably made of plastic, around a spool. Such apparatus comprises drive means configured for rotating a spool around a winding axis. The spool is provided with a winding core extending along the winding axis. Delivery means are configured for delivering an elongated retaining element, preferably a retaining film, at said spool. The delivery means are preferably movable along the winding axis. Winding means are also provided, which are configured for at least partially winding the elongated retaining element around the winding core so as to retain a free end of the continuous flexible elongated element on the winding core.

Preferably, the winding means comprise the drive means and locking means configured for locking a flap of the elongated retaining element with respect to the spool.

In this way, the apparatus is simplified and it is possible to obtain a complete automation of the method.

Preferably, the locking means comprise at least one clamp configured for locking a flap of the elongated retaining element with respect to the spool. The clamp is configured for being integral with the spool in rotation around the winding axis in use configuration of said apparatus.

Preferably, cutting means are provided for said elongated retaining element, preferably operatively associated with the delivery means Preferably, the delivery means comprise at least one shaft configured for supporting in rotation a coil of the elongated retaining element. The shaft is arranged parallel to the winding axis of the spool and preferably higher than the winding axis of the spool.

Preferably, thrust means are provided, which are configured for thrusting the continuous flexible elongated element towards the winding core and preferably comprising at least two drive members arranged alongside each other so as to form an airspace for sliding and a guide element suitable for being arranged between the drive members and the spool.

Preferably, the thrust means are movable away from and towards the spool, in a use configuration of the apparatus.

Further characteristics and advantages of the present invention will become more apparent from the description of a exemplary, but not exclusive, and therefore non-limiting preferred embodiment of an apparatus for winding a continuous flexible elongated element, as illustrated in the appended figures, in which.

Figure 1:
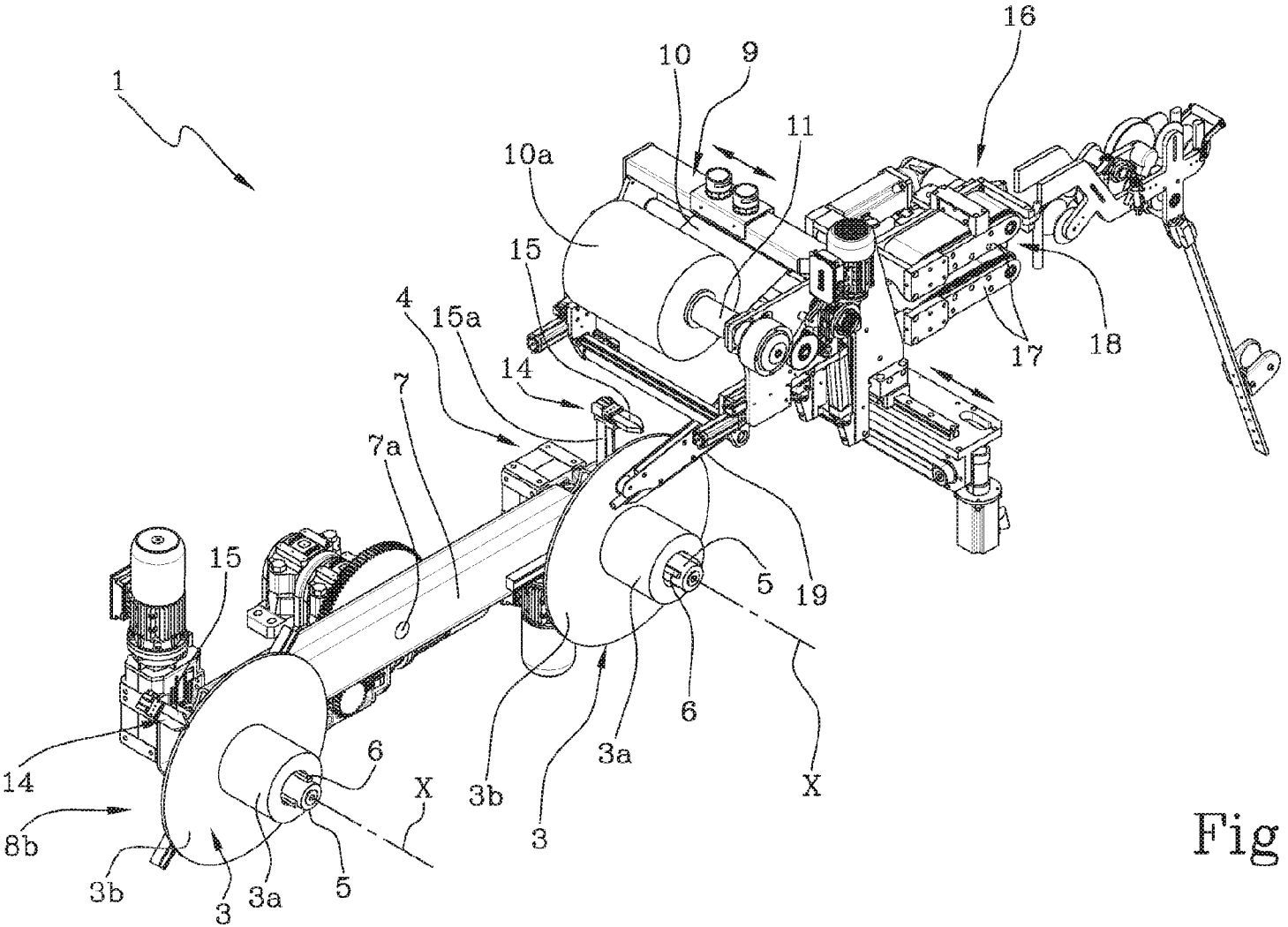
FIG. 1 is a schematic, perspective view of an apparatus for winding a continuous flexible elongated element according to the present invention.

FIGS. 6*a*-6*g* are schematic views of the operation sequence of the apparatus according to FIG. 1, in accordance with a method for winding a continuous flexible elongated element according to the present invention.

Figure 2:
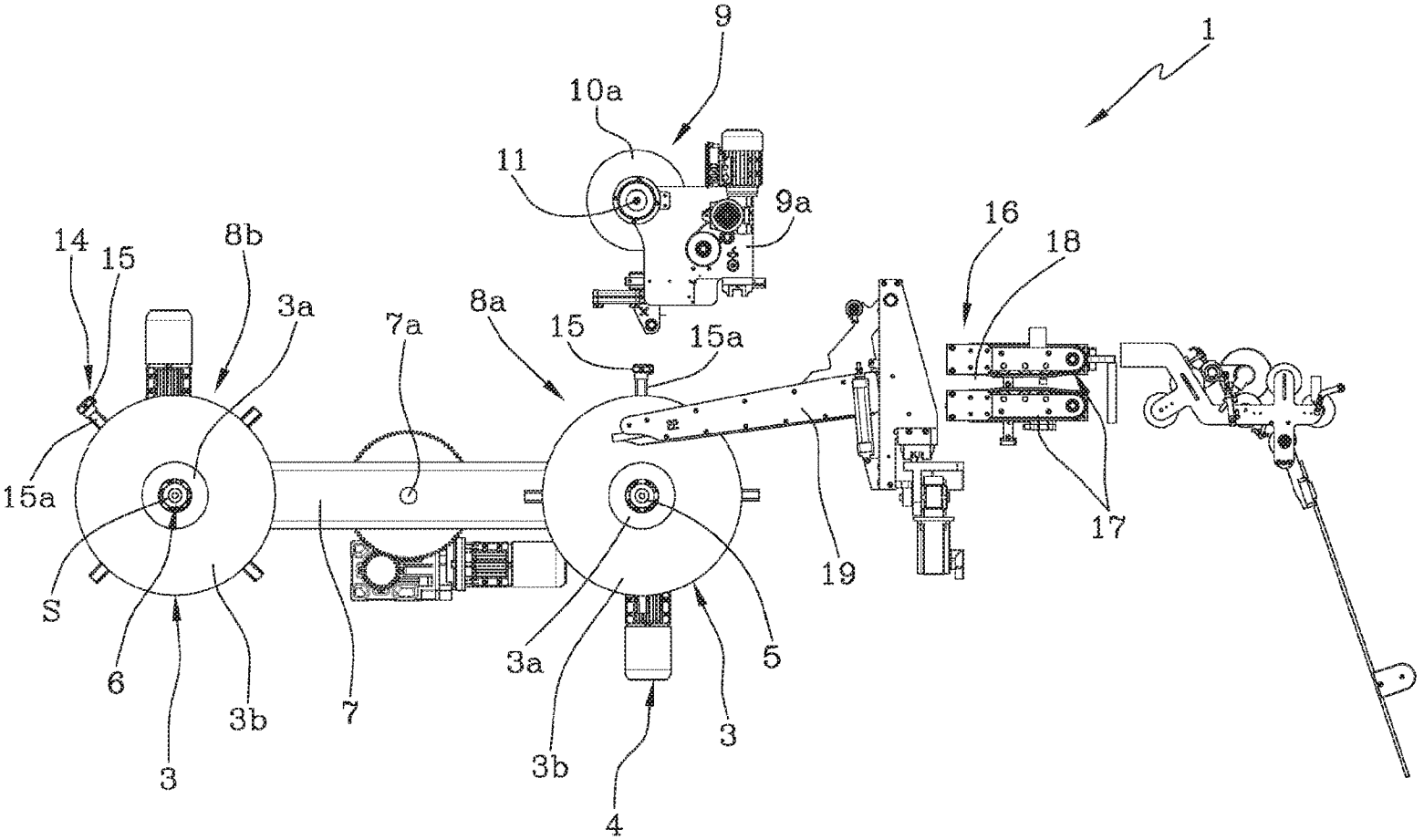
FIG. 2 is a schematic side view of the apparatus of FIG. 1.

With reference to the attached figures, and in particular to FIGS. 1 and 2, the number 1 globally indicates an apparatus for winding a continuous flexible elongated element 2 (FIG. 6*d*-6*g*) around a coil 3 to form a coil.

The continuous flexible elongated element 2 is preferably made of plastic and is, for example, a flexible tube or a rubber profile.

The spool 3 comprises a winding core 3*a* defining a cylindrical surface around which the continuous flexible elongated element 2 is wound. The winding core 3*a* is internally hollow and extends along a winding axis X.

The spool 3 also comprises two shoulders 3*b* respectively defined for example by a disk and arranged at the ends of the winding core. For simplicity of illustration, in the accompanying figures the spool/s have been illustrated with only one shoulder 3*b* to highlight the winding core 3*a*.

The apparatus 1 comprises drive means 4 configured for rotating the spool 3 around the winding axis X.

In particular, the drive means 4 comprise a motorized shaft 5 adapted to be inserted internally in the spool 3, and in particular in the winding core 3*a*, so as to drag it in rotation around the winding axis X. The shaft 5 comprises interference means 6 adapted to make the spool 3 integral with the shaft 5 in rotation around the winding axis X.

In accordance with a possible embodiment, the apparatus 1 comprises two shafts 5 arranged at the ends of a rod 7 pivoted centrally in a fulcrum 7*a* to differentiate a first winding position 8*a* from a second loading position 8*b* of an empty spool and lacking the coil formed.

9 refers to delivery means configured for delivering an elongated retaining element 10 at the spool, located in the first position, for example.

Preferably, the elongated element 10 is realized by means of a stretchable retaining film made of a plastic such as, for example, a linear low-density polyethylene.

According to a possible embodiment, the delivery means 9 comprise at least one axis 11 configured for supporting in rotation a coil 10*a* of the elongated retaining element 10.

The axis 11 is arranged parallel to the winding axis X of the spool 3. Moreover, the axis 11 is preferably arranged higher than the winding axis X of the spool 3.

Figure 3:
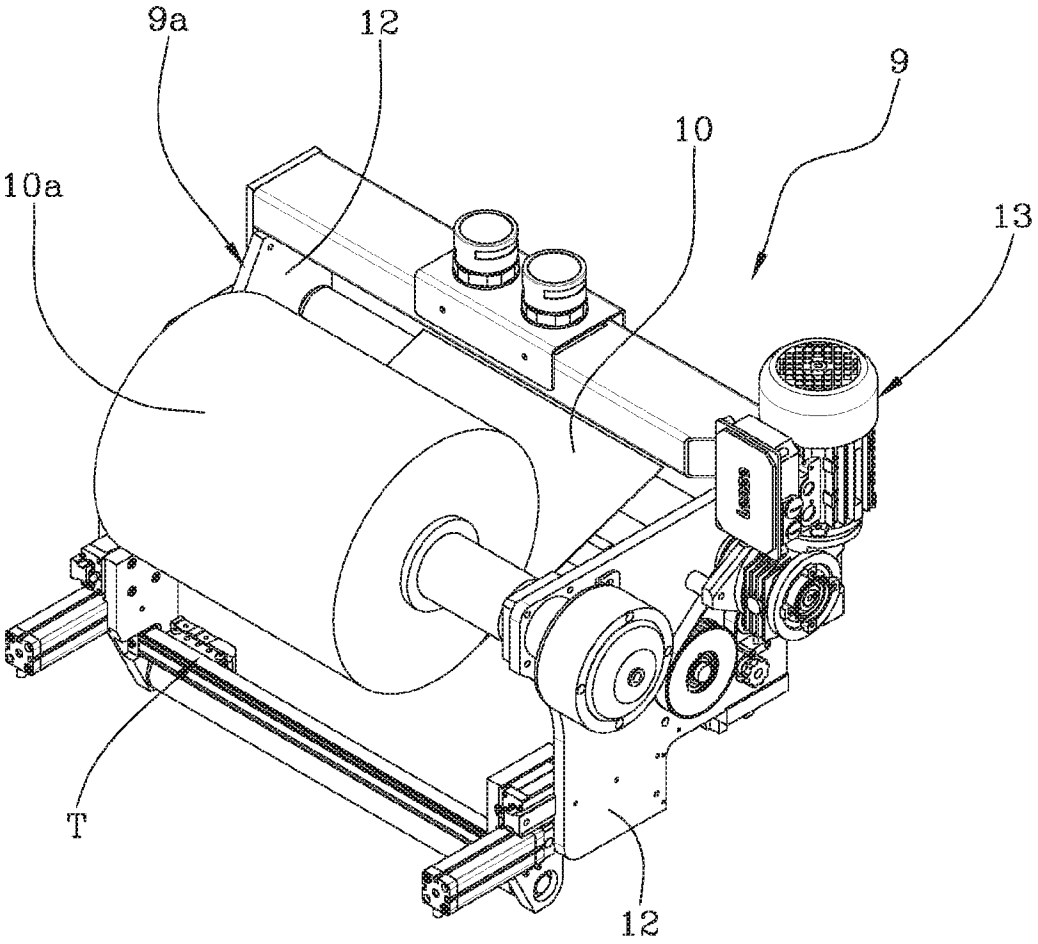
FIG. 3 is a schematic, perspective view of a detail of the apparatus of FIG. 1.
Figure 4:
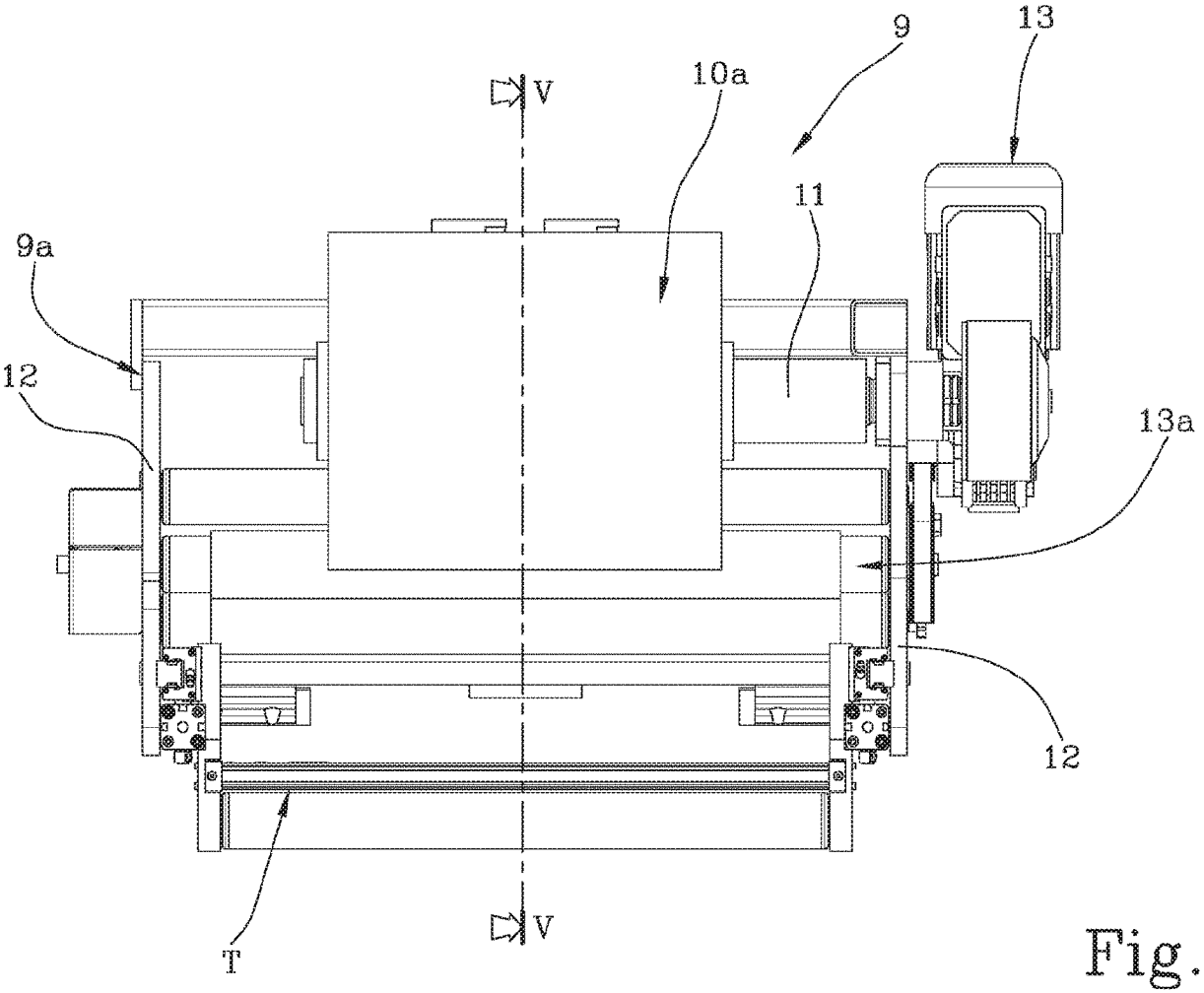
FIG. 4 is a schematic front view of the detail of FIG. 3.
Figure 5:
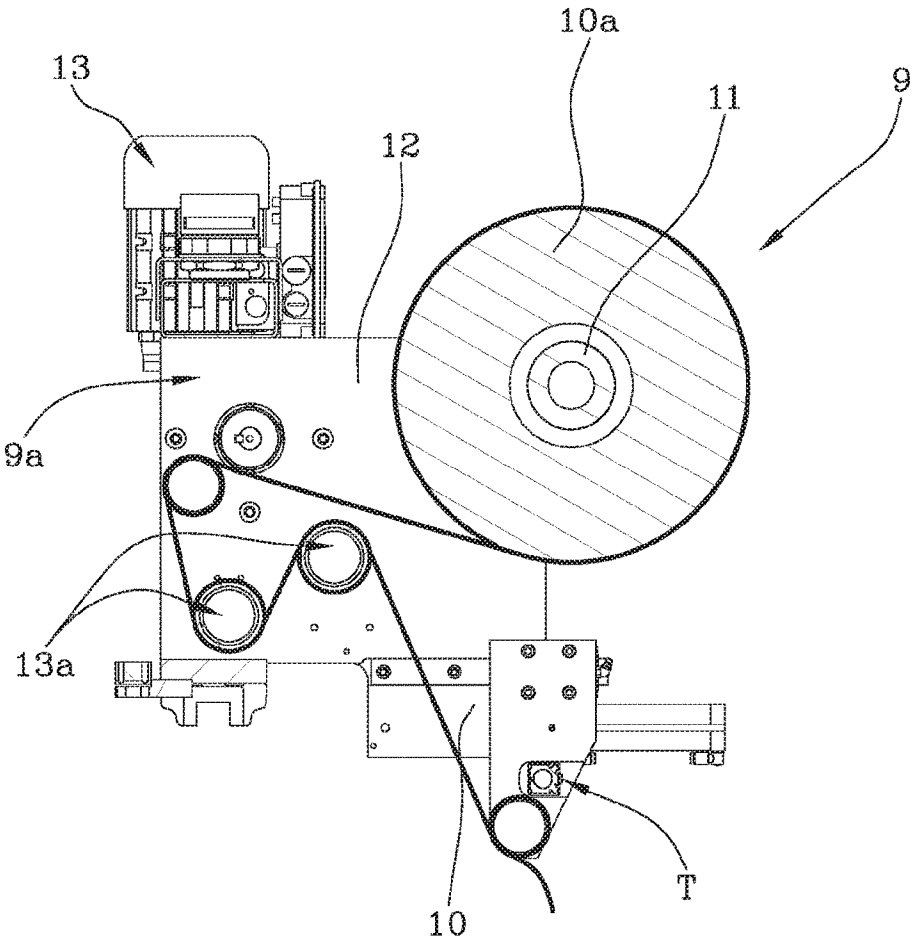
FIG. 5 is a sectional view along the line V-V of the detail of FIG. 4.

According to a possible embodiment, for example illustrated in FIGS. 3-5, the delivery means 9 comprise an unit 9*a* defined by two opposing plates 12 supporting the axis 11 and motor means 13 suited to unwind the elongated retaining element 10 by the coil 10*a*. In accordance with a possible embodiment, the motor means 13 comprise at least two friction rollers 13*a* suited to unwind the elongated retaining element 10 by the coil 10*a* and to tension it.

According to a possible embodiment, cutting means T are provided, for example a cylinder provided with a cutting blade, for the elongated retaining element. Preferably, the cutting means are operatively associated with the delivery means 9. In particular, the cutting means are arranged on the unit 9*a* defining the delivery means 9.

The delivery means 9, and in particular the units 9*a*, are movable along a direction parallel to the winding axis X of the spool 3.

Winding means configured for at least partially winding the elongated retaining element 10 around the winding core 3*a* so as to retain a free end 2*a* of the continuous flexible elongated element 2 on the winding core 3.

In particular, the winding means can comprise the drive means 4 and locking means 14 configured for locking a flap 10*b* of the elongated retaining element 10 with respect to the spool 3. In other words, the locking means 14 are configured for making a flap 10*b* of the elongated retaining element 10 integral with the spool 3 in its rotation around the axis of winding X to allow the winding of the elongated retaining element 10 around the winding core 3*a*.

According to a possible embodiment, the locking means 14 comprise at least one clamp 15 configured for locking a flap 10*b* of the elongated retaining element 10 with respect to the spool 3. The clamp 15 is configured for being integral with the spool 3 in rotation around the winding axis X in use configuration of said apparatus 1.

Preferably, the clamp 15 is arranged radially outwardly of the overall radial dimension of the spool 3. Alternatively, the clamp 15 is arranged on a shoulder 3*b* of the spool 3. In general, the clamp 15 is arranged so as to block a flap 10*b* of the elongated retaining element 10 with respect to the spool 3 at a shoulder 3*b* of the spool itself.

According to a possible embodiment, the clamp 15 is integral with the shaft 5 of the drive means 4 by means of, for example, an arm 15*a* arranged radially with respect to the shaft 5. In use configuration of the apparatus 1, in which the spool 3 is arranged on the shaft 5, the arm 15*a* is arranged, with reference to a direction parallel to the axis of winding X, externally to the spool 3 while the clamp 15 extends at least partially towards the inside of the spool 3. In use configuration of the apparatus 1, in which the spool 3 is arranged on the shaft 5, the arm 15*a* extends, with reference to a radial direction with respect to the winding axis X, beyond the radial dimensions of the spool 3.

16 refers to the thrust means configured for thrusting the continuous flexible elongated element 2 towards the winding core 3*a*. In accordance with a possible embodiment, the thrust means 16 preferably comprise at least two drive members 17 arranged alongside each other so as to form an airspace 18 for sliding of the continuous flexible elongated element 2. In accordance with a possible embodiment, the thrust means 16 preferably comprise a guide element 19 suitable for being arranged between the drive members 17 and the spool 3. The guide element 19 is movable along a direction parallel to the winding axis X of the spool 3.

Figure 6B:
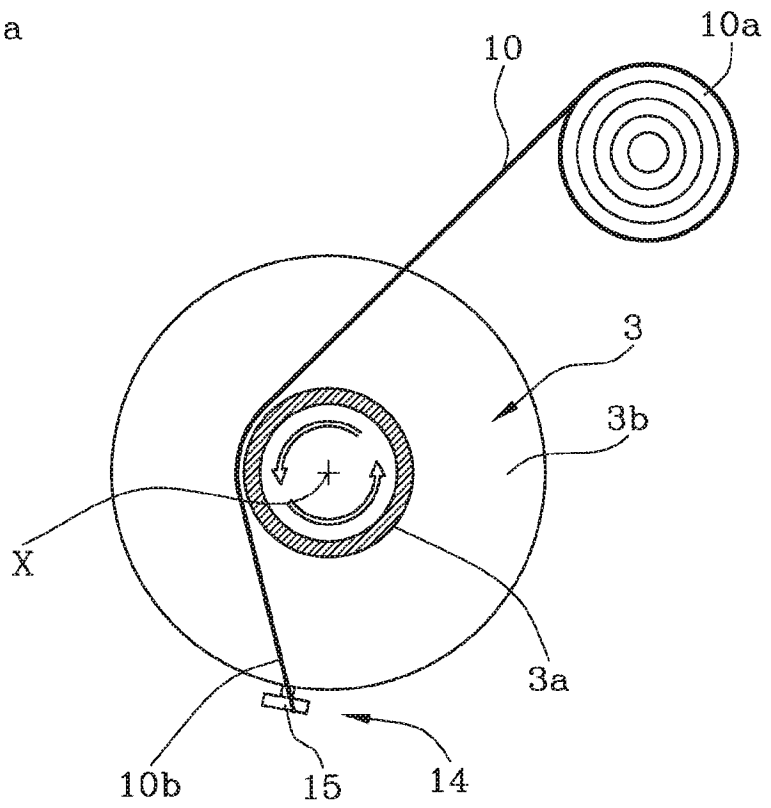

Preferably, the thrust means are movable away from and towards the spool 3, in a use configuration of the apparatus. In FIG. 6*d* an advancement A of the thrust means 16, in particular of the guide element 19, is schematically shown.

In use, the apparatus 1 allows to implement a method for winding the continuous flexible elongated element 2 around the spool 3, according to the present invention.

FIGS. 6*a*-6*g* illustrate a possible sequence of steps of the method.

Figure 6A:
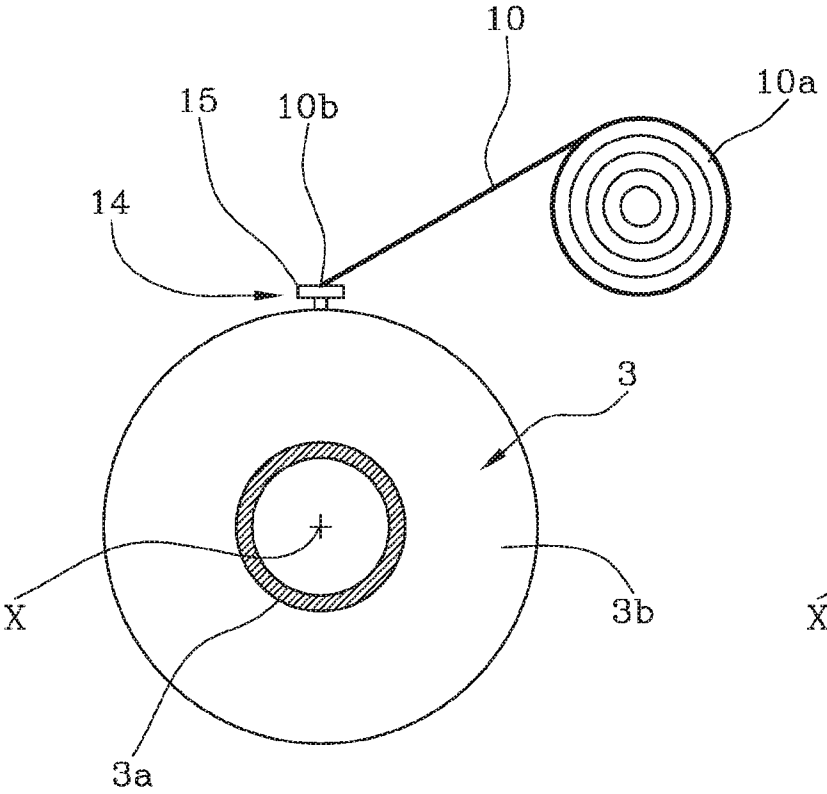
Figure 6D:
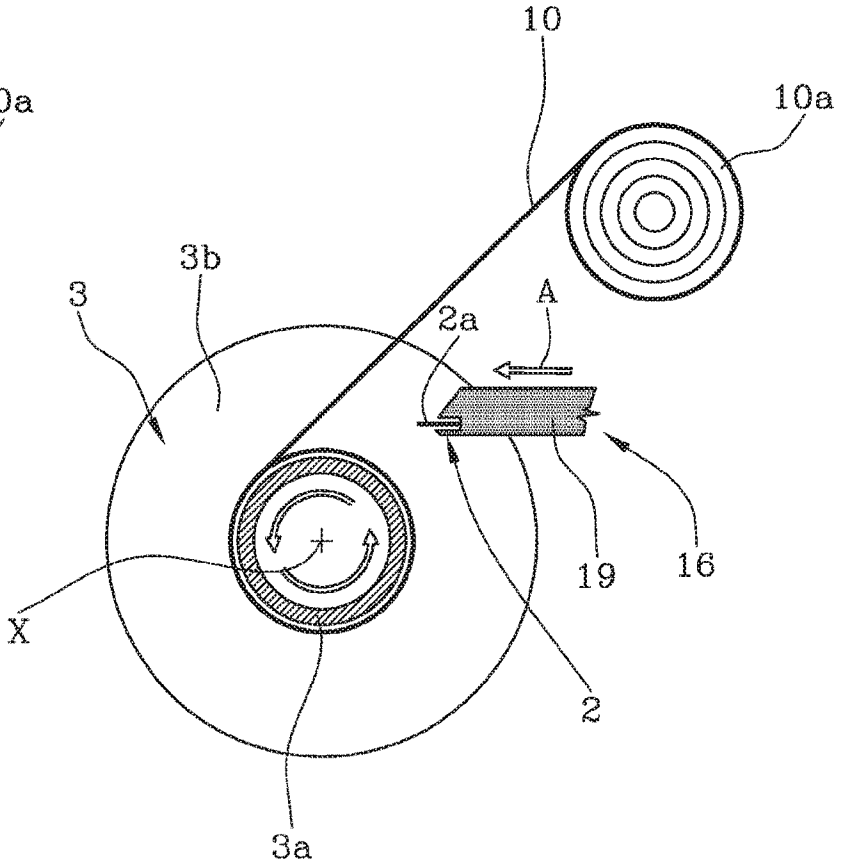

FIG. 6*a* illustrates the step of preparing the spool 3 and of the elongated retaining element 10.

The step of preparing the elongated retaining element 10 comprises a step of unwinding of the elongated retaining element 10 from a coil 10*a* arranged with axis parallel to the winding axis X of the spool 3. In particular, the step of preparing the elongated retaining element 10 is effected by dropping from above a flap 10*b* of the elongated retaining element 10 towards the winding core 3*a*.

The FIG. 6*a* also illustrates a step of locking the flap 10*b* of the elongated retaining element 10 with respect to the spool 3, for example by means of the locking means 14, in particular by means of the clamp 15. The locking step has the purpose of setting in rotation said flap 10*b* integrally with the spool 3, in order to cause the at least partial winding of the elongated retaining element 10 around the winding core 3*a* in rotation. Thanks to the position of the locking means 14, the locking step is preferably executed at a shoulder 3*b* of the spool 3 or externally to the overall radial dimension of the spool 3.

The elongated retaining element 10 is unwound from the coil 10*a* and preferably tensioned by the motor means 13.

Figure 6C:
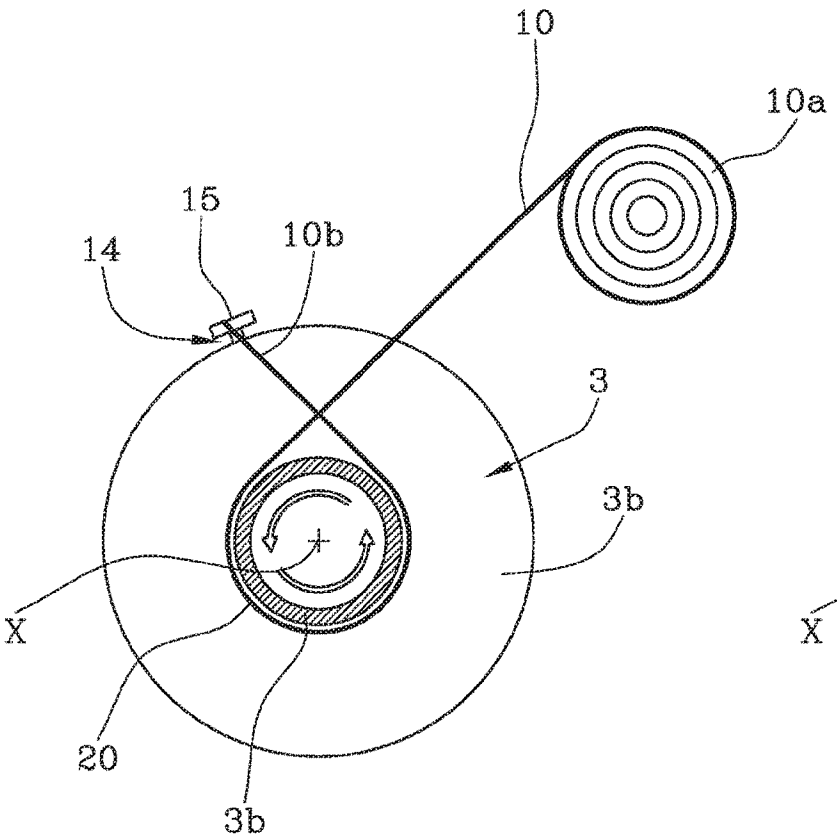

FIGS. 6*b* and 6*c* illustrate the step of at least partial winding of the elongated retaining element 10 around the winding core 3*a*. In particular, FIGS. 6*b* and 6*c* illustrate a first step of at least partial winding of the elongated retaining element 10 around the winding core 3*a*. Preferably, the first step of at least partial winding of the elongated retaining element 10 is effected so as to generate at least one turn or complete winding of the elongated retaining element 10 around the winding core 3*a*. In the transition from the configuration of FIG. 6*a* to the configuration of FIG. 6*c*, the delivery means 9, and in particular the unit 9*a*, translate along the winding axis X of the spool 3 from a position close to the locking means 14 and away from them. In other words, at least the first step of at least partial winding of the elongated retaining element 10 is realized by means of a relative motion of roto-translatory type between the elongated retaining element 10 and winding core 3*a*

In general, the first step of at least partial winding of the elongated retaining element 10 is realized until the same is locked on the winding core 3*a*, in order to unlock the flap 10*b* with respect to the spool 3. In particular, the formation of at least one coil 20 or a complete winding of the elongated retaining element 10 around the winding core 3*a* allows the elongated retaining element 10 to be locked on the winding core 3*a*.

According to the example shown in FIGS. 6*b*, 6*c*, the step of at least partial winding of the elongated retaining element 10, and in particular the first winding step, includes rotating the spool 3 around the winding axis X.

In the transition from the situation of FIG. 6*c* to that of FIG. 6*d*, step is provided for unlocking the flap 10*b*. In particular, this unlocking step is provided at the end of the first step of at least partial winding of the elongated retaining element 10, for example once the first coil 20 is wound.

Preferably at the end of the first step of winding the elongated retaining element 10, the step of winding the continuous flexible elongated element 2 around the winding core 3*a* in rotation around the winding axis X begins, starting from the free end 2*a* of the continuous flexible elongated element itself, as shown in FIGS. 6*d*-6*g*. The step of at least partial winding of the elongated retaining element 10 around the winding core 3*a* is effected so as to retain the free end 2*a* of the continuous flexible elongated element 2 on the winding core 3*a*.

Preferably, the step of at least partial winding of the elongated retaining element 10 around the winding core 3*a* comprises a first winding step wherein the elongated retaining element 10 is at least partially wound onto the winding core 3*a* before the step of winding the continuous flexible elongated element 2 (FIGS. 6*a*-6*d*), and a second winding step wherein the elongated retaining element 10 is at least partially wound onto the winding core 3*a* and onto the continuous flexible elongated element 2 starting from its free end 2*a* (FIGS. 6*d*-6*g*).

Preferably, the spool 3 is rotated around the winding axis both in the first step of winding and in the second step of winding. According to an alternative (not shown), the spool 3 is rotated around the winding axis X only in the second step of winding. In this case, to carry out the first winding step, that is, in order to lock the elongated retaining element 10 on the winding core 3*a*, it can be provided that the spool 3 remains stationary and that the locking means 14, for example the clamp 15, rotate around the winding axis X.

Figure 6F:
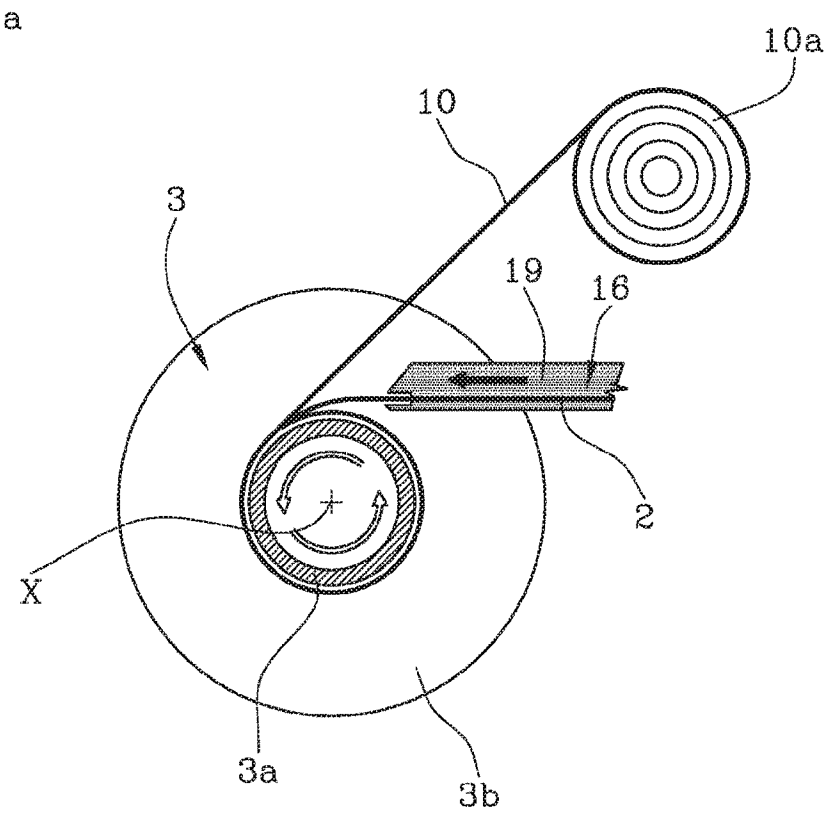
Figure 6E:
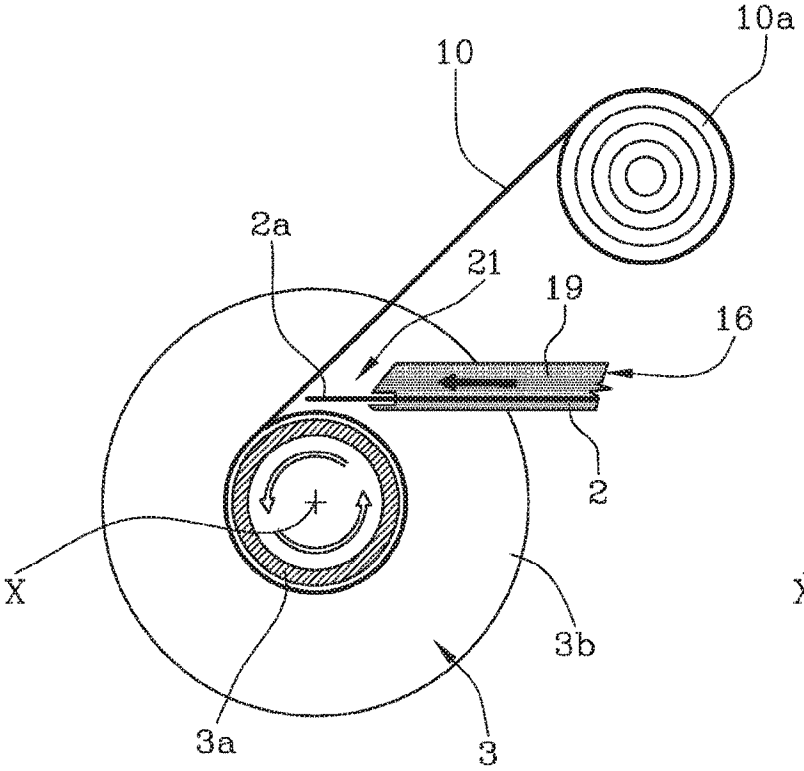

In accordance with a possible embodiment, illustrated for example in FIGS. 6*d* and 6*e*, before the continuous flexible elongated element 2 is retained on the winding core 3*a* by the elongated retaining element 10, step is provided for thrusting the continuous flexible elongated element 2 towards the winding core 3*a*. Such thrust step is performed, for example, by the thrust means 16.

The free end 2*a* of the continuous flexible elongated element 2 is inserted into a mouth 21 (FIG. 6*e*) formed between the spool 3 and the elongated retaining element 10. Preferably, a first advancement A of the thrust means 16 is performed, in particular of the guide element 19, as illustrated in FIG. 6*d*.

Figure 6G:
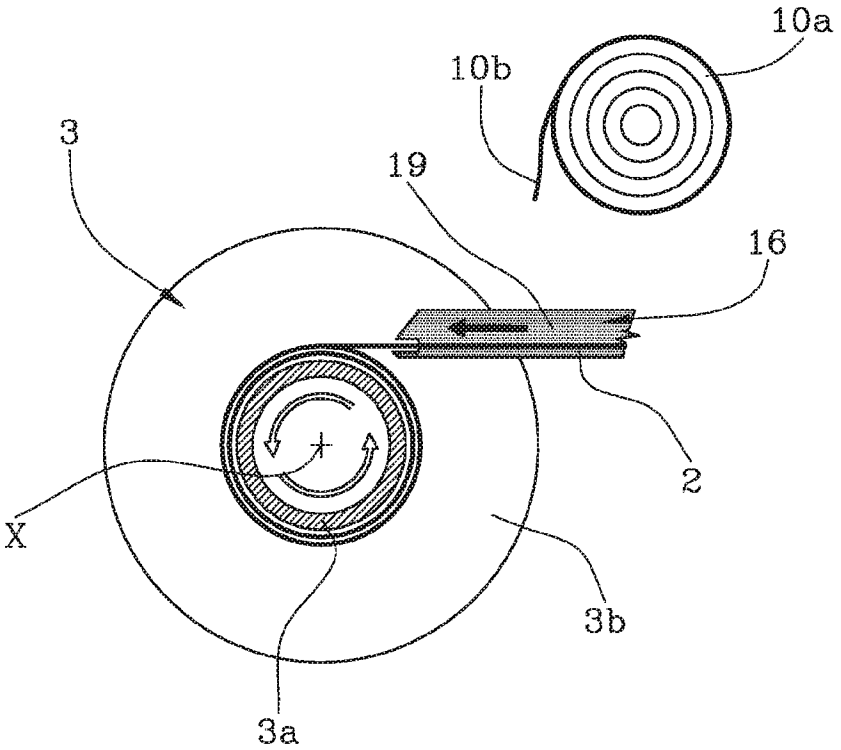

It follows that the step of winding said continuous flexible elongated element 2 around the winding core 3*a* in rotation comprises an initial winding step wherein the continuous flexible elongated element 2 is predominantly thrust towards said winding core 3*a* (FIGS. 6*d*-*f*) and a subsequent winding step wherein the continuous flexible elongated element 2 is predominantly dragged by the spool 3 being retained on the winding core 3*a* by the elongated retaining element 10 (FIG. 6*g*).

In the transition from the situation illustrated in FIG. 6*f* to the situation illustrated in FIG. 6*g*, a step is provided for cutting the elongated retaining element 10. This cutting step is realized when the continuous flexible elongated element 2 is held on the winding core 3*a* by the elongated retaining element.

Preferably, the cutting step is realized at the end of the second winding step of the elongated retaining element 10, when the continuous flexible elongated element 2 is held on the winding core by the elongated retaining element 10.

The invention claimed is:

1. A method for winding a continuous flexible elongated element around a spool, comprising steps as follows:

providing a spool including a winding core, providing an elongated retaining element, at least partially winding the elongated retaining element around the winding core, winding the continuous flexible elongated element around the winding core in rotation around a winding axis, starting from a free end of the continuous flexible elongated element, wherein the step of at least partially winding the elongated retaining element around the winding core is includes retaining the free end of the continuous flexible elongated element on the winding core;

wherein the step of at least partially winding the elongated retaining element around the winding core includes locking a flap of the elongated retaining element with respect to the spool using a locking device including a clamp attached to the spool to rotate with the spool around the winding axis.

2. The method of claim 1, wherein the step of at least partially winding the elongated retaining element around the winding core comprises a first winding step wherein the elongated retaining element is at least partially wound onto the winding core before the step of winding the continuous flexible elongated element, and a second winding step wherein the elongated retaining element is at least partially wound onto the winding core and onto the continuous flexible elongated element starting from the free end to retain the continuous flexible elongated element on the winding core.

3. The method according to claim 2, wherein the first winding step includes generating at least one turn of the elongated retaining element around the winding core, by a relative roto-translatory motion between the elongated retaining element and the winding core.

4. The method according to claim 2, and further comprising a step of cutting the elongated retaining element when the continuous flexible elongated element is retained on the winding core by the elongated retaining element.

5. The method according to claim 4, wherein the step of cutting is performed at an end of the second winding step when the continuous flexible elongated element is retained on the winding core by the elongated retaining element.

6. The method according to claim 2, wherein the locking the flap is executed at a shoulder of the spool or externally to an overall radial dimension of the spool; and the step of at least partial winding the elongated retaining element includes the step of setting the spool in rotation around the winding axis.

7. The method according to claim 6, and further comprising a step of unlocking the flap at an end of the first winding.

8. The method according to claim 2, and further comprising, before the continuous flexible elongated element is retained on the winding core by the elongated retaining element, a step of thrusting the continuous flexible elongated element towards the winding core.

9. The method according to claim 2, wherein the step of winding the continuous flexible elongated element around the winding core in rotation comprises an initial winding step wherein the continuous flexible elongated element is thrust towards the winding core and a subsequent winding step wherein the continuous flexible elongated element is dragged by the spool being retained on the winding core by the elongated retaining element.

10. The method according to claim 1, wherein the step of providing the elongated retaining element comprises a step of unwinding the elongated retaining element from a coil arranged with an axis of the coil parallel to the winding axis.

11. The method according to claim 1, wherein the step of providing the elongated retaining element includes by dropping from above the flap of the elongated retaining element towards the winding core.

12. An apparatus for winding a continuous flexible elongated element around a spool, comprising:

a drive mechanism including a motor for setting the spool in rotation around a winding axis, the spool including a winding core extending along the winding axis, a delivery mechanism including a motor for delivering an elongated retaining element at the spool, the delivery mechanism, the delivery mechanism being translationally movable along the winding axis, a winding mechanism including the drive mechanism for at least partially winding the elongated retaining element around the winding core to retain a free end of the continuous flexible elongated element on the winding core, wherein the winding mechanism further comprises a locking device for locking a flap of the elongated retaining element with respect to the spool, and wherein the locking device includes a clamp for locking a flap of the elongated retaining element with respect to the spool, the clamp being attached to the spool to rotate with the spool around the winding axis.

13. The apparatus according to claim 12, and further comprising a cutting device including a blade for cutting the elongated retaining element, the cutting device being operatively associated with the delivery mechanism.

14. The apparatus according to claim 12, wherein the delivery mechanism further comprises a shaft for rotatably supporting a coil of the elongated retaining element, the shaft being arranged parallel to the winding axis and positioned higher than the winding axis.

15. The apparatus according to claim 12, and further comprising a thrust device for thrusting the continuous flexible elongated element towards the winding core, the thrust device comprising two drive members arranged alongside each other to form an airspace for thrusting and a guide element for guiding the continuous flexible elongated element, the guide element arranged between the two drive members and the spool.

16. The apparatus according to claim 15, wherein the guide element is movable away from and towards the spool.

* * * * *